United States Patent [19]

Ambrose

[11] Patent Number: 4,653,549

[45] Date of Patent: Mar. 31, 1987

[54] CONICAL FLUID NOZZLE

[75] Inventor: Clarence M. Ambrose, Seattle, Wash.

[73] Assignee: C. M. Ambrose Company, Redmond, Wash.

[21] Appl. No.: 792,550

[22] Filed: Oct. 29, 1985

[51] Int. Cl.[4] ..... B65B 3/04

[52] U.S. Cl. ..... 141/5; 141/286; 239/590

[58] Field of Search ..... 239/590; 141/285-310, 141/1-12

[56] References Cited

U.S. PATENT DOCUMENTS

| | | | |
|---|---|---|---|
| 883,176 | 3/1908 | Davis | 239/515 |
| 1,495,713 | 5/1924 | Phillips | 239/515 |
| 1,964,836 | 7/1934 | Wheaton | 239/590 |
| 3,312,402 | 4/1967 | Lyon | 239/515 |
| 3,415,294 | 12/1968 | Kelly | 239/552 |
| 3,462,085 | 8/1969 | Nugarus | 141/1 |

*Primary Examiner*—Houston S. Bell, Jr.
*Attorney, Agent, or Firm*—Seed and Berry

[57] ABSTRACT

A nozzle for dispensing a viscous fluid into a container at a high flow rate. The nozzle has a body for receiving a fluid flow and a nozzle tip for causing a substantially continuous fluid wall to be ejected from the nozzle. A fluid flow breaker in the nozzle is place in the fluid flow to create a reduced thickness portion in the fluid wall. Air trapped between the fluid wall and rising fluid in the container exits the wall through the reduced thickness portion thereby reducing the amount of splattering which may occur. A drip-limiting cup is provided in the nozzle to reduce the amount of dripping from the nozzle which may occur after the fluid flow to the nozzle is discontinued.

17 Claims, 2 Drawing Figures

CONICAL FLUID NOZZLE

DESCRIPTION

1. Technical Field

The invention relates to an apparatus and a method for filling a container with a viscous fluid. Specifically, the invention relates to a method and apparatus for filling a container with a viscous fluid with a minimum of dripping and splattering.

2. Background of the Art

Various devices have been available for controlling and preventing splashing and splattering of fluids dispensed from a spigot. In the water faucet art, the device disclosed by Davis in U.S. Pat. No. 883,176 obviates the splashing and splattering usually incident to the discharge of water therefrom. The device comprises a thin strip of spring metal folded into a series of deep, transverse corrugations which are bent into a loop to fit into the opening of a conventional stopcock. While devices of this type may be effective for use with less viscous fluid such as water, fluids having increased viscosity present further problems.

For example, in U.S. Pat. No. 3,415,294 issued to Kelly, the disadvantageous foaming of milk is alleviated by the placement of screens close the the aperture of a nozzle. In U.S. Pat. No. 3,462,085 issued to Nugarus, a nozzle is disclosed which develops a conical film of coating material for application to articles to be packaged by a film of such material. The nozzle is particularly adapted to handling high viscosity coatings.

When filling paint cans with viscous fluids such as paint or oil, splashing and dripping of the fluid is a serious problem which has been heretofore unavoidable by using conventional techniques or the methods. It would be highly desirable to dispense viscous fluid such as paint into a paint can in a conical flow using a cone nozzle. However, a serious disadvantage arises when a container is filled with a viscous fluid using a conical flow. Typically, a pocket of air or larger air bubble is trapped within the cone of fluid which is formed, with the fluid within the container sealing the bottom of the cone. As the level of fluid rises, the air bubble becomes compressed and eventually bursts through the sidewall of the cone causing splattering of the paint onto the outside of the container.

Therefore a need exists for a method and apparatus which can quickly fill a container with a viscous fluid utilizing a conical flow of such fluid while minimizing the burst effect of an air bubble formed within the fluid cone. There is a further need for a nozzle which will not drip for a prolonged time period after the flow has ceased.

Disclosure of the Invention

Therefore, it is an object of the present invention to form a substantially continuous conical wall of fluid for filling a container while minimizing splattering due to the rupture of the wall by air trapped between the cone wall and the fluid in the container.

It is a further object of the invention to provide a device which can fill a container with a viscous material having a conical wall under a variety of fluid viscosities and delivery pressures.

It is yet another object of the invention to minimize dripping of the fluid into the container after the flow of fluid has been stopped.

Basically, the invention achieves these objects and other objects and advantages which will become apparent from the description which follows, by providing a nozzle body having an inlet for accepting a flow of viscous fluid and having an outlet which dispenses fluid into the container in the form of an outwardly directed, substantially continuous fluid wall. A nozzle tip having a sidewall is placed within the outlet. The nozzle tip is positioned such that the sidewall exists in a spaced relation to a control surface on the outlet. The nozzle tip sidewall can be in the form of a frustrum wherein the control surface on the outlet is substantially parallel to the nozzle tip sidewalls. The outwardly expanding, substantially continuous fluid wall thus created is directed into the container. A fluid flow breaker is positioned at the outlet in the path of the fluid flow. The breaker causes an opening or reduced thickness of a portion in the fluid wall. This reduced thickness portion of the fluid wall constitutes a weakened area in the wall. Air entrapped in an air pocket formed between the fluid wall and the rising level of fluid in the container is forced through the opening or the reduced thickness portion of the wall rather than through a thicker portion of the continuous film wall. Thus, air escaping through the opening or weakened portion displaces less fluid from the wall and minimizes splattering of fluid on the outside of the container.

It has been found that by providing a weakened area in the substantially continuous fluid wall, very high flow rates can be achieved without significant splattering or splashing of the fluid in the container.

A drip-reducing cup can be provided in the nozzle to isolate the fluid inlet from the fluid outlet. Thus, only the fluid which is in the cup will exit the nozzle outlet after the fluid flow is discontinued. The rest of the delivery system is effectively isolated from the outlet thereby greatly reducing dripping.

BEST MODE FOR CARRYING OUT THE INVENTION

Figure 1:
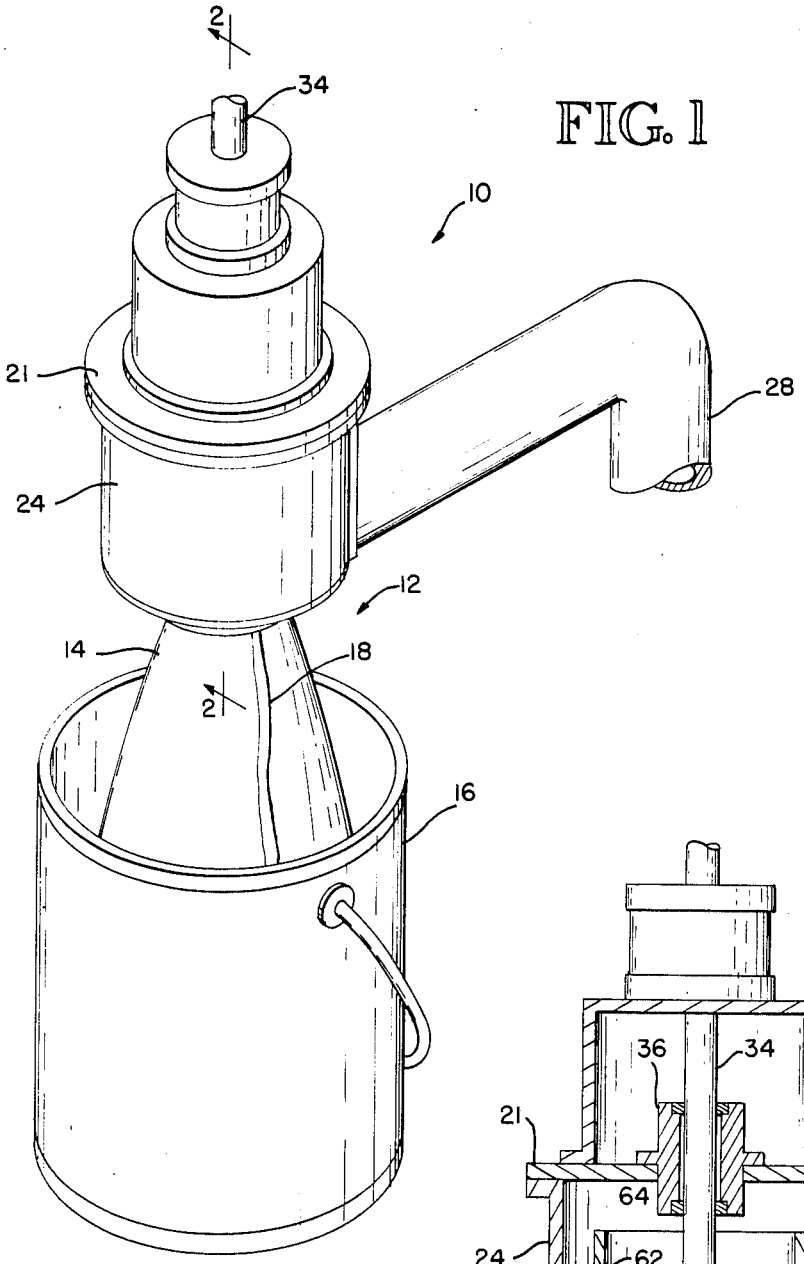
FIG. 1 is an isometric view of a conical nozzle in accordance with the present invention, dispensing fluid in a conical wall into a container.

In FIG. 1, a nozzle body 10 is shown dispensing a viscous fluid 12 in a conical flow forming a cone of fluid 14 into a conventional container or can 16. The fluid cone 14 has a generally conical sidewall and an interior air space therewithin. It has been found that by filling containers with a viscous fluid using a conical flow, high filling rates can be achieved.

In the case of a viscous fluid such as paint or oil, splashing of the fluid can cause dripping of the fluid down the outside of the can. This is highly undesirable. Although the conical flow allows high filling rates, a heretofore unsolved splashing problem arises. Air becomes trapped within the fluid cone 14 and is compressed by the rising level of fluid within the container 16. The increasing pressure of the trapped air bubble eventually bursts through the sidewall of the fluid cone causing the fluid to splatter onto the outside of the container or onto the adjacent container or surrounding area. It has been discovered that by providing an opening or a reduced thickness wall portion 18 in the sidewall of the fluid cone, the air bubble tends to escape through the opening or weakened reduced thickness wall portion with significantly less splattering of the viscous fluid. It is preferred to cause an opening in the wall to relieve the air pressure. However, due to the viscousity of certain fluids, the reduced thickness portion more readily occurs. As used herein, a reduced wall thickness portion is intended to include an opening in the wall.

Figure 2:
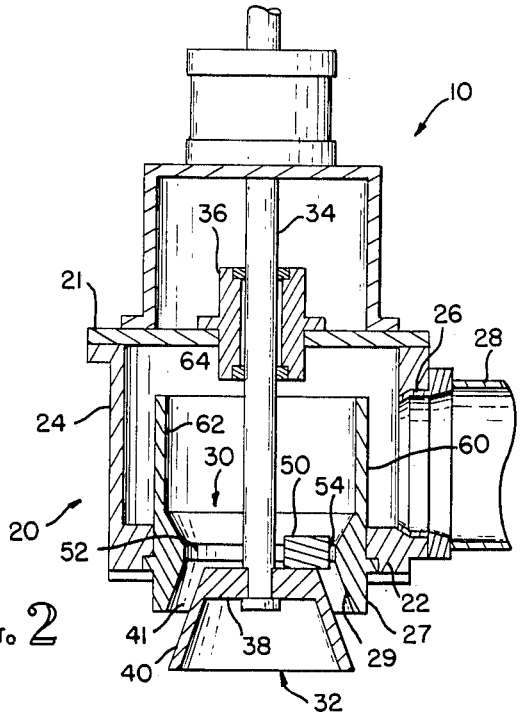
FIG. 2 is a sectional view of the nozzle of FIG. 1 taken generally along line 2—2 of FIG. 1.

FIG. 2 illustrates the mechanism by which the reduced thickness wall portion 18 is created in the fluid cone 14. The nozzle 10 has a lower fluid-conducting housing 20. The housing has an upper end wall 21 and a lower annular member 22 which are joined together in a fluid-tight relation by a sidewall 24. In the preferred embodiment, the housing sidewall 24 and the annular member 22 are formed as an integral unit. The side 24 has a fluid inlet 26 for receiving a viscous fluid under pressure through a conduit 28. The annular member 22 of the nozzle body supports a valve seat 27 having a control surface 29 which is outwardly and downwardly tapered. The valve seat 27 defines an outlet 30 for dispensing the fluid.

A nozzle tip, generally indicated at reference numeral 32, is movably positioned within the outlet 30 for cooperation with the control surface 29 of the valve seat 27 to form the fluid cone 14. A valve stem 34 extends through and is slidably disposed in an opening in the upper end wall 21 of the housing 20 and is connected to the nozzle tip to control its position. A fluid-tight seal is provided by a packing gland 36 positioned in the opening in the upper end wall 21. Vertical movement of the valve stem adjusts the distance between the nozzle tip 32 and the control surface 29. The nozzle tip 32 has a base portion 38 to which one end of the valve stem 34 is attached.

The base portion of the nozzle tip has a downwardly and outwardly depending frusto-conical sidewall 40. A fluid passage 41 is formed between the nozzle tip sidewall 40 and the control surface 29 which are oriented substantially to each other. The nozzle tip sidewall 40 and the control surface 29 are maintained in a spaced-apart relation by the vertical positioning of the valve stem 34 to select the size of the fluid passage so that the fluid cone 14 can be formed with any desired wall thickness. In such manner, fluids of different viscosities may be delivered through the conduit 28 under various pressures and flow rates and the nozzle tip 32 adjusted to provide the desired fluid cone 14. It is noted that the sidewall of the fluid cone 14 has a substantially uniform thickness and undesirable splattering will result unless the fluid cone is provided with a reduced thickness wall portion in accordance with the present invention.

The reduced thickness wall portion 18 in the fluid cone 14 is formed by a fluid flow breaker 50. In the presently preferred embodiment of the invention, the flow breaker is a rectangular block fixed to the base portion 38 of the nozzle tip 32. As shown in FIG. 2, a portion of the flow breaker 50 is positioned to obstruct or disturb the fluid flow through the fluid passage 41 defined by the sidewall 40 and control surface 29. The disruption causes the reduced thickness wall portion 18 to form in the fluid cone 14. The valve seat 27 includes a vertical surface 52 projecting upwardly from the control surface 29. The vertical surface is substantially oriented parallel to a vertical face 54 of the flow breaker 50 so that a portion of the flow breaker is always positioned to disturb the flow of fluid through the fluid passage as the nozzle tip 32 is moved within the working range of the valve stem 34. The face 54 of the flow breaker 50 is positioned in a spaced-apart relation from the vertical surface 52 to allow free vertical movement of the nozzle tip 32.

The introduction of the high filling rates achievable with the present invention have also made it desirable to reduce the period of time a filled container must stay beneath the filling nozzle 10 after the flow has been discontinued in order to allow the nozzle to drain completely before the next container is moved beneath the nozzle. If the filled container is moved before the nozzle is completely drained, undesirable dripping will occur. As shown in FIG. 2, the nozzle 10 includes a drip-limiting cup 60 to isolate the fluid inlet 26 from the outlet 30. The cup is formed by a cylindrical sidewall 62 which projects upwardly from the upper end of the valve seat 27 into the fluid conducting housing 20 and extends around the outlet 30. In the presently preferred embodiment, the cup 60 and the valve seat 27 are formed as an integral unit. The cup has an open bottom which is in registration with the outlet. The cup also has an open top 64 which is preferably disposed above the inlet 26.

When fluid flow in the conduit 28 is relieved, fluid remaining in the conduit and below the level of the top 64 of the cup 60 is effectively isolated from the outlet 30. Therefore, only fluid remaining within the open bottomed cup or within the housing 20 above the top 64 of the cup is available to drain through the outlet 30 into the container 16. It has been found that by isolating the outlet from the inlet in this manner, the amount of time which a container must remain beneath the nozzle 10 after the flow stops to wait for the nozzle to drain is greatly reduced. In effect, the cup reduces the interior volume of the nozzle which must drain, thus reducing the amount of dripping which occurs. In this way the number of containers which may be filled without dripping fluid down the side of the containers as they move into and out of the filling position under the nozzle is greatly increased for a given time interval.

It will be appreciated that other variations of the present invention are contemplated and will be obvious to those skilled in the art. For example, the shape of the flow breaker need not be rectangular as shown in the drawings, but may be any suitable shape which disturbs a portion of the fluid flow through the outlet to cause a reduced thickness wall portion in the fluid cone produced by the nozzle tip. Furthermore, the conical shape of the nozzle tip may be varied in size and shape to provide an appropriate fluid flow for various containers. The present invention may be used with any shape of fluid flow which has a substantially continuous sidewall and traps an air bubble therein as the fluid level in the container being filled rises. Therefore, the invention is not to be limited by the above description but is to be determined by the scope of the claims which follow.

I claim:

1. A nozzle for dispensing a viscous fluid into a container, comprising:

a nozzle body defining a cavity and having an inlet for receiving a fluid flow and an outlet having a fluid control surface;

a nozzle tip having a sidewall within the outlet for cooperation with the outlet control surface to control the flow of fluid through the outlet for dispensing into the container;

means for positioning the nozzle tip sidewall in a spaced relation to the outlet control surface so that the fluid is dispensed from the outlet with a substantially continuous, sheet like fluid wall enclosing an air pocket between the nozzle tip, the fluid wall and the fluid deposited in the container; and a flow breaker positioned at the outlet in the path of the fluid flow to reduce the thickness of a portion of the fluid wall thereby allowing air entrapped in the air pocket to be freed through the reduced thickness portion of the fluid wall to minimize splattering of the fluid.

2. The nozzle of claim 1 wherein the nozzle tip has a base connected to the positioning means and wherein the nozzle tip sidewall extends downwardly and outwardly from the base to form a frustum, whereby the fluid wall assumes a conical shape.

3. The nozzle of claim 2 wherein the outlet has a substantially vertical surface projecting upwardly from the control surface and wherein the flow breaker is a block attached to the nozzle tip base and having a face substantially parallel to and spaced apart from the vertical surface of the outlet.

4. The nozzle of claim 3 wherein the nozzle tip positioning means is adjustable to vary the space between the nozzle tip sidewall and the outlet control surface to form a fluid wall having a desired thickness for fluids of differing viscosities delivered to the nozzle under differing pressures.

5. The nozzle of claim 2 wherein the positioning means comprises a valve stem having one end attached to the nozzle tip base and being movable relative to the nozzle body to adjust the space between the nozzle tip sidewall and the body control surface.

6. The nozzle of claim 2 wherein the flow breaker is attached to the nozzle tip base above the nozzle tip sidewall and extends to a position to disturb the fluid flow between the nozzle tip sidewall and the outlet control surface.

7. The nozzle of claim 6 wherein the flow breaker is a block.

8. The nozzle of claim 1, further including a drip limiting cup to isolate the nozzle body outlet from the inlet, the cup having a continuous side extending upwardly into the nozzle body cavity from the outlet, the cup having an open bottom in registration with the outlet and an open top above the outlet, the nozzle body inlet being disposed outside of the cup and below the level of the open top of the cup so that only fluid remaining interior of the cup or thereabove in the nozzle body cavity can drip through the outlet when the fluid flow is stopped.

9. A nozzle for dispensing a viscous fluid into a container, comprising:

a nozzle body defining a cavity and having a top and a bottom joined in a fluid-tight relation by a side portion, the side portion having an inlet for receiving a flow of viscous fluid and the bottom having an outlet with a conical fluid control surface;

a nozzle tip positioned within the outlet having a base with a downwardly extending conical sidewall for cooperation with the control surface to control the flow of fluid through the outlet for dispensing into the container;

a valve stem having one end attached to the base of the nozzle tip and being movable relative to the nozzle body to adjustably position the nozzle tip sidewall in a spaced relation with the control surface to form a fluid passageway therebetween to dispense fluid from the outlet with a substantially continuous, sheet like conical fluid wall; and a flow breaker block attached to the nozzle tip base and positioned to disturb the fluid flow in the fluid passageway and thereby reduce the thickness of a portion of fluid wall to cause air trapped between the nozzle tip, fluid wall and the fluid in the container to exit the wall through the reduced thickness portion.

10. The nozzle of claim 9, further including a drip-limiting cup to isolate the outlet from the inlet, the cup having a continuous side extending upwardly into the nozzle body cavity from the outlet, the cup having an open bottom in registration with the outlet and an open top above the outlet, the nozzle body inlet being disposed outside of the cup and below the level of the open top of the cup so that only fluid remaining interior of the cup or thereabove in the nozzle body cavity can drip through the outlet when the fluid flow is stopped.

11. A method for filling a container with a viscous fluid, comprising the following steps:

placing a container beneath a fluid dispensing nozzle;

causing a fluid flow into the nozzle;

dispensing a substantially continuous, sheet like wall of fluid from the nozzle into the container wherein the fluid wall defines an air pocket therewithin between the nozzle and fluid in the container; and disturbing a portion of the fluid flow to reduce the thickness of a portion of the fluid wall so that air entrapped in the air pocket is forced through the reduced thickness portion of the fluid wall by the rising level of fluid in the container.

12. The method of claim 11 wherein the fluid flow within the nozzle is disturbed.

13. A nozzle for dispensing a viscous fluid into a container, comprising:

a nozzle body defining a chamber having an inlet for receiving a fluid flow and an outlet for dispensing the fluid into a container;

a nozzle tip positioned within the outlet to produce a substantially continuous, sheet like fluid wall for dispensing fluid into the container, the fluid wall enclosing an air pocket between the nozzle tip and the fluid deposited into the container; and a member positioned in the fluid path to reduce the thickness of a portion of the fluid wall and thereby allow air entrapped in the air pocket to escape through the reduced thickness wall portion.

14. The nozzle of claim 13 wherein the member is positioned within the chamber.

15. The nozzle of claim 13 wherein the member is a block.

16. The nozzle of claim 13, further including a drip limiting cup to isolate the outlet from the inlet, the cup being positioned in the chamber and having an open lower end in registration with the outlet and an open upper end above the outlet, the nozzle body inlet being disposed outside of the cup.

17. A nozzle for filling containers with a viscous fluid, comprising:

means for dispensing a viscous fluid into a container in a substantially continuous, sheet like fluid wall enclosing an interior air pocket; and means for reducing the thickness of a portion of the fluid wall so that air entrapped in the air pocket is forced through the fluid wall at the reduced thickness wall portion by the rising level of fluid in the container.

* * * * *